US006102138A

United States Patent [19]

Fincher

[11] Patent Number: 6,102,138

[45] Date of Patent: Aug. 15, 2000

[54] PRESSURE-MODULATION VALVE ASSEMBLY

[75] Inventor: Roger W. Fincher, Conroe, Tex.

[73] Assignee: Baker Hughes Incorporated, Houston, Tex.

[21] Appl. No.: 09/135,914

[22] Filed: Aug. 18, 1998

Related U.S. Application Data

[60] Provisional application No. 60/056,591, Aug. 20, 1997.

[51] Int. Cl.[7] ..... E21B 4/00

[52] U.S. Cl. ..... 175/100; 175/25; 175/94; 175/101

[58] Field of Search ..... 175/48, 107, 101, 175/93, 94, 106, 100, 25

[56] References Cited

U.S. PATENT DOCUMENTS

| | | | |
|---|---|---|---|
| 3,203,184 | 8/1965 | Whittle et al. | 175/94 |
| 3,550,697 | 12/1970 | Hobhouse | 175/26 |
| 4,079,795 | 3/1978 | Sackmann et al. | 175/24 |
| 4,201,363 | 5/1980 | Arendt et al. | 251/62 |
| 4,273,186 | 6/1981 | Pearce et al. | 166/72 |
| 4,284,141 | 8/1981 | Mott | 166/315 |
| 4,378,931 | 4/1983 | Adams, Jr. | 251/58 |
| 4,610,307 | 9/1986 | Jurgens et al. | 175/320 |
| 4,615,401 | 10/1986 | Garrett | 175/230 |
| 4,660,656 | 4/1987 | Warren et al. | 175/26 |
| 4,698,794 | 10/1987 | Kruger et al. | 367/83 |
| 4,721,172 | 1/1988 | Brett et al. | 175/26 |
| 4,768,598 | 9/1988 | Reinhardt | 175/26 |
| 4,807,708 | 2/1989 | Forrest et al. | 175/45 |
| 4,901,806 | 2/1990 | Forrest | 175/321 |
| 5,022,471 | 6/1991 | Maurer et al. | 175/75 |
| 5,050,692 | 9/1991 | Beimgraben | 175/61 |
| 5,099,931 | 3/1992 | Krueger et al. | 175/75 |
| 5,113,953 | 5/1992 | Noble | 175/61 |
| 5,156,222 | 10/1992 | Jurgens et al. | 175/26 |
| 5,205,364 | 4/1993 | Jurgens et al. | 175/38 |
| 5,265,682 | 11/1993 | Russell et al. | 175/45 |
| 5,311,952 | 5/1994 | Eddison et al. | 175/61 |
| 5,316,094 | 5/1994 | Pringle | 175/74 |
| 5,339,913 | 8/1994 | Rives | 175/73 |
| 5,343,967 | 9/1994 | Kruger et al. | 175/75 |
| 5,360,075 | 11/1994 | Gray | 175/61 |
| 5,394,951 | 3/1995 | Pringle et al. | 175/61 |
| 5,419,405 | 5/1995 | Patton | 175/27 |
| 5,679,894 | 10/1997 | Kurger et al. | 73/152.03 |
| 5,704,436 | 1/1998 | Smith et al. | 175/27 |

FOREIGN PATENT DOCUMENTS

| | | |
|---|---|---|
| WO 95/21987 | 8/1995 | WIPO . |
| WO 96/38653 | 12/1996 | WIPO . |
| WO 98/01651 | 1/1998 | WIPO . |

*Primary Examiner*—Robert E. Pezzuto
*Assistant Examiner*—Kristine M. Markovich
*Attorney, Agent, or Firm*—Duane, Morris & Hechscher LLP

[57] ABSTRACT

A drillstring pressure-modulation valve which is usable in combination with a downhole drilling motor and a drillstring thruster to compensate for changes in pressure drop through the drilling motor which normally occur during drilling. When conditions change during drilling, which in turn changes the pressure drop through the drilling motor, the drillstring pressure-modulation valve compensates for such changes to minimize the effect of such changes on the operation of the thruster and the resulting WOB created by the thruster. The modulation valve has a feature which allows it to find automatically a balanced preload condition for the main needle valve, the primary functional element within the modulation valve, each time the rig pumps are turned off and then turned on. The modulation valve is fully self-contained, and is assembled as part of the bottomhole assembly. The device senses the no-load pressure drop in the system and sets itself each time the rig pumps are turned on to compensate for any change in the no-load pressure drop experienced below the device which could be attributable to such things as motor wear, bit nozzle plugging, or changes in the flow rate. Accordingly, the hydraulic thrusting force remains constant over a wide range of drilling environments. As the drilling conditions change and the pressure drop in the downhole motor increases, the needle valve shifts to compensate for such additional pressure drop with a resultant small or no effect on the thruster and the resulting WOB created by the thruster located upstream of this modulation valve.

24 Claims, 7 Drawing Sheets

PRESSURE-MODULATION VALVE ASSEMBLY

This application is a continuation-in-part of provisional application No. 60/056,591 dated Aug. 20, 1997.

FIELD OF THE INVENTION

The field of this invention relates to drilling string pressure-modulation valves, particularly those useful in combination with a drillstring thruster used in conjunction with a drilling motor during drilling.

BACKGROUND OF THE INVENTION

One way drilling a borehole can be accomplished is by circulation of fluid through a downhole motor which is operably connected to the drill bit. Such bottomhole assemblies have, at times in the past, employed thrusters in an effort to improve drilling efficiency. The thruster is a telescoping tube arrangement which allows the drill bit to advance while the tubing string is supported in a rather stationary position at the surface. Ultimately, when the thruster has advanced its full stroke, or a notable portion thereof, the drill string is lowered from the surface, which causes the upper end of the thruster to slide down and therein close the thruster for the next stroke. When the drilling kelly or the stand being drilled down by the top drive reaches the drill rig floor, circulation is interrupted and another piece of tubing is added to the string at the surface or the coiled tubing is further unspooled into the wellbore. This also causes the thruster to retract as a result of this procedure and the drilling procedure using the downhole motor begins once again.

In the past, depending on drilling conditions, fluid resistance in the downhole motor varies as a result of torque generated at the drill bit which is connected to the drilling motor. Fluctuations of pressure drop through the motor caused by the above-noted bit torque change has in the past impeded the function of the thruster. What had occurred in the past was that the thruster responded to changes in pressure drop through the downhole motor instead of simply maintaining a fixed weight on bit as the drill bit advanced at a constant weight on bit (WOB). The inability of the thruster to maintain relatively constant weight on bit, regardless of the amount of work the drilling motor was required to do, caused instability to such thrusters to the point of negating their functional operation and negatively impacting the drilling operation. What occurred was a pressure increase due to higher torque load on the motor as a result of changing drilling conditions. The higher or increased pressure was sensed at the thruster, causing it to try to extend the telescoping portion out further, which in turn increased the WOB. Ultimately, with increasing WOB, the motor torque was greater and the pressure sensed by the thruster was therein greater and drilling would cease as the thruster drove the motor in a stall condition where the drill bit is no longer turning.

In these past applications of the thruster, the WOB was a function of the pressure difference between inside and outside the thruster. The greater the difference, the more force on the bit is exerted by the thruster. As a result, assemblies using thrusters with downhole motors in combination with drill bits have not been as efficient and useful as possible.

An object of this invention is to provide a pressure-modulation valve in the bottomhole assembly between the thruster and the downhole motor to compensate for pressure increases as a result of changing drilling conditions which have, in the past, caused an increase in torque and, as a result, winched the WOB applied by the thruster. Ultimately, it is the function of this invention to make a thruster operable when used in conjunction with the drilling motor so that it can efficiently and reliably, without undue cycling or oscillation, feed out pipe in response to advancement of the drill bit during the drilling operation. Use of the pressure-modulation valve facilitates a constant WOB since variations in pressure drop in the circulating mud in the drilling motor do not affect the relative force exerted on the bit. With the modulation feature fully effective, these variations in pressure drop are compensated by the pressure-modulation valve with the result being a facilitation of a constant WOB regardless of motor differential pressure.

SUMMARY OF THE INVENTION

A drillstring pressure-modulation valve is disclosed which is usable in combination with a downhole drilling motor and a drillstring thruster to compensate for changes in pressure drop through the drilling motor which normally occur during drilling. When conditions change during drilling, which in turn changes the pressure drop through the drilling motor, the drillstring pressure-modulation valve compensates for such changes to minimize the effect of such changes on the operation of the thruster and the resulting WOB created by the thruster. The modulation valve has a feature which allows it to find automatically a balanced preload condition for the main needle valve, the primary functional element within the modulation valve, each time the rig pumps are turned off and then turned on. The modulation valve is fully self-contained, and is assembled as part of the bottomhole assembly. The device senses the no-load pressure drop in the system and sets itself each time the rig pumps are turned on to compensate for any change in the no-load pressure drop experienced below the device which could be attributable to such things as motor wear, bit nozzle plugging, or changes in the flow rate. Accordingly, the hydraulic thrusting force remains constant over a wide range of drilling environments. As the drilling conditions change and the pressure drop in the downhole motor increases, the needle valve shifts to compensate for such additional pressure drop with a resultant small or no effect on the thruster and the resulting WOB created by the thruster located upstream of this modulation valve.

DETAILED DESCRIPTION OF THE DRAWINGS

Figure 1A:
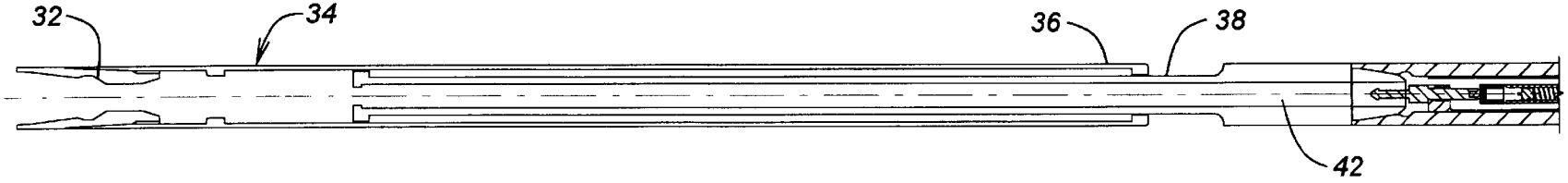
Figure 1B:
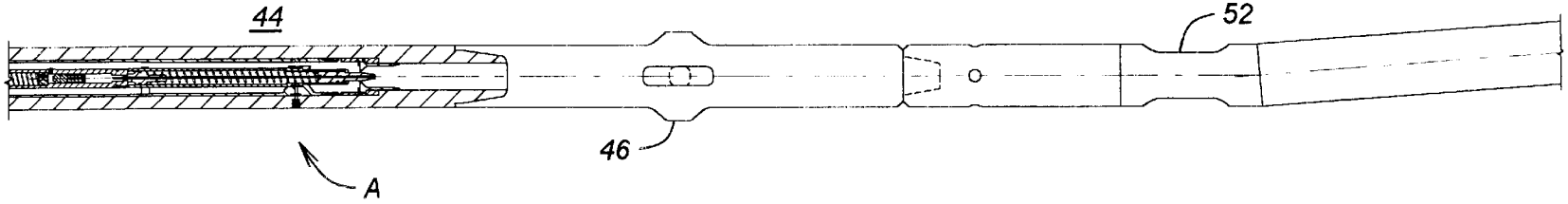
Figure 1C:
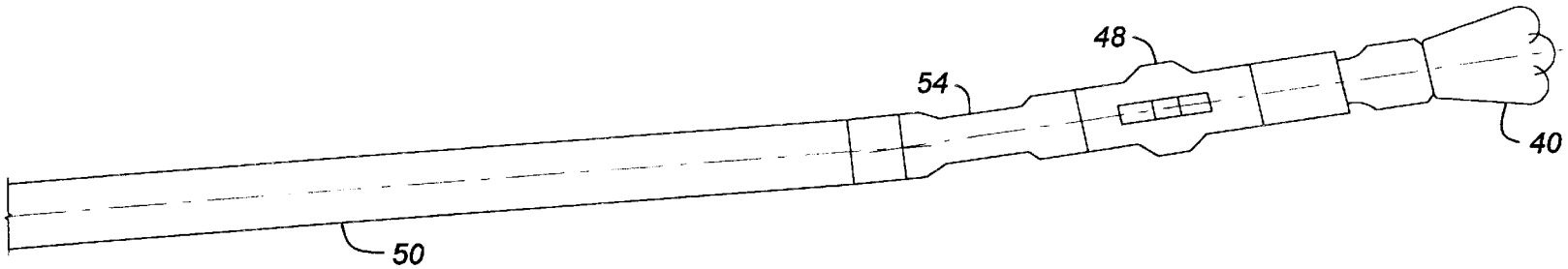

FIGS. 1*a–c* illustrate a bottomhole assembly in a sectional elevation view, showing the layout of the components, as well as a possible location for a measurement-while-drilling system which can be used in tandem with the apparatus.

Figure 2A:
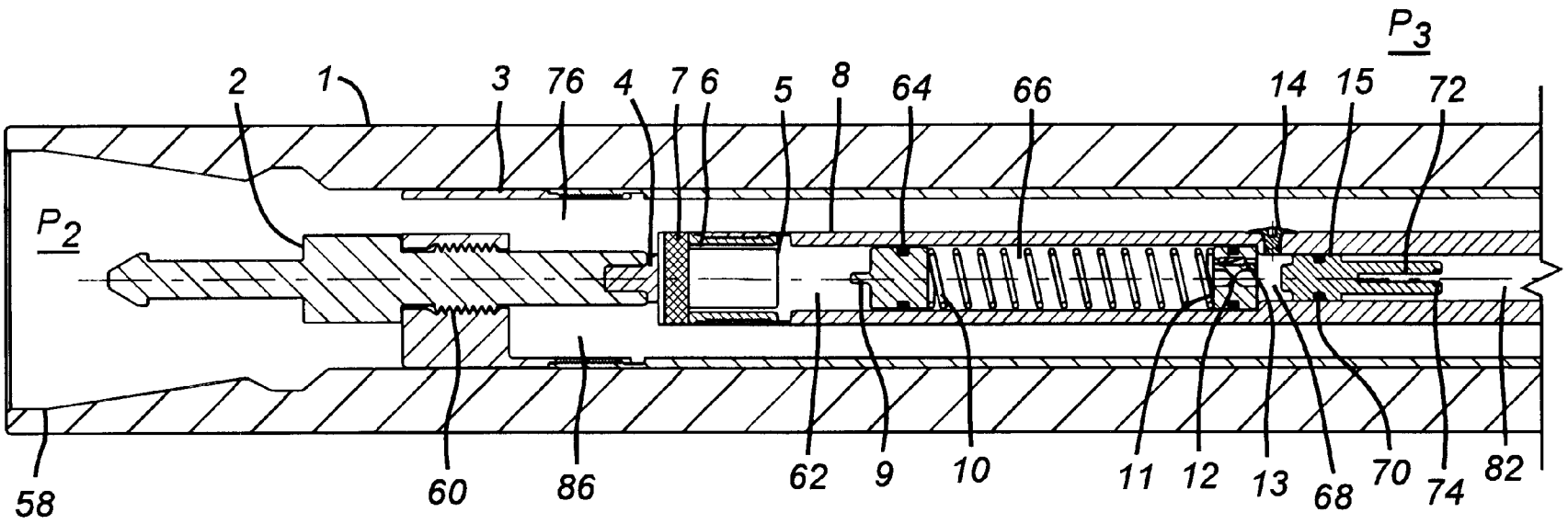
Figure 2B:
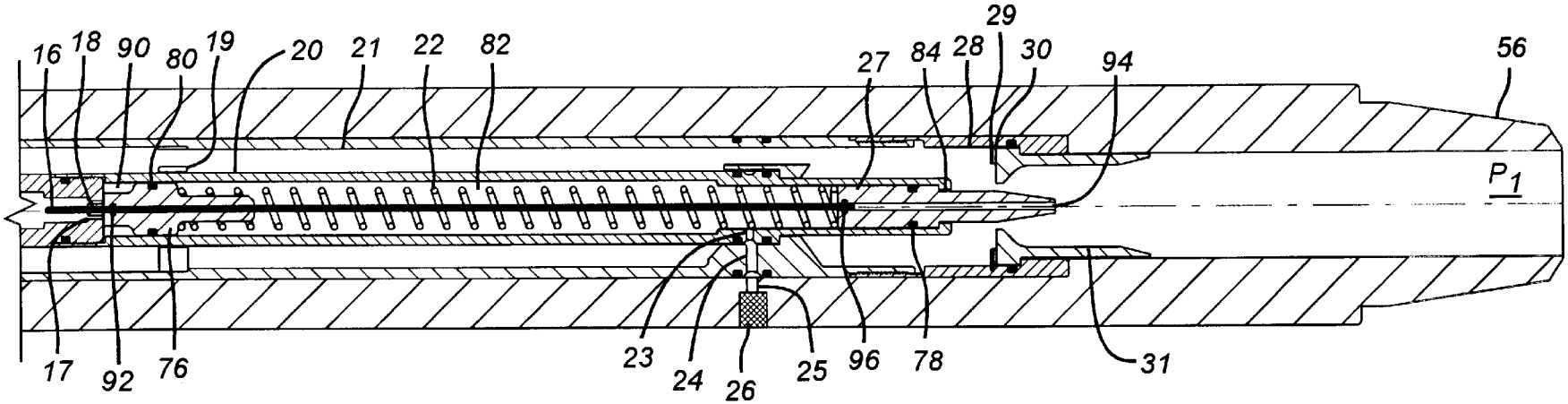

FIGS. 2*a–b* are a sectional view of the drillstring pressure-modulation valve in the run-in position without the rig pump circulating.

Figure 3A:
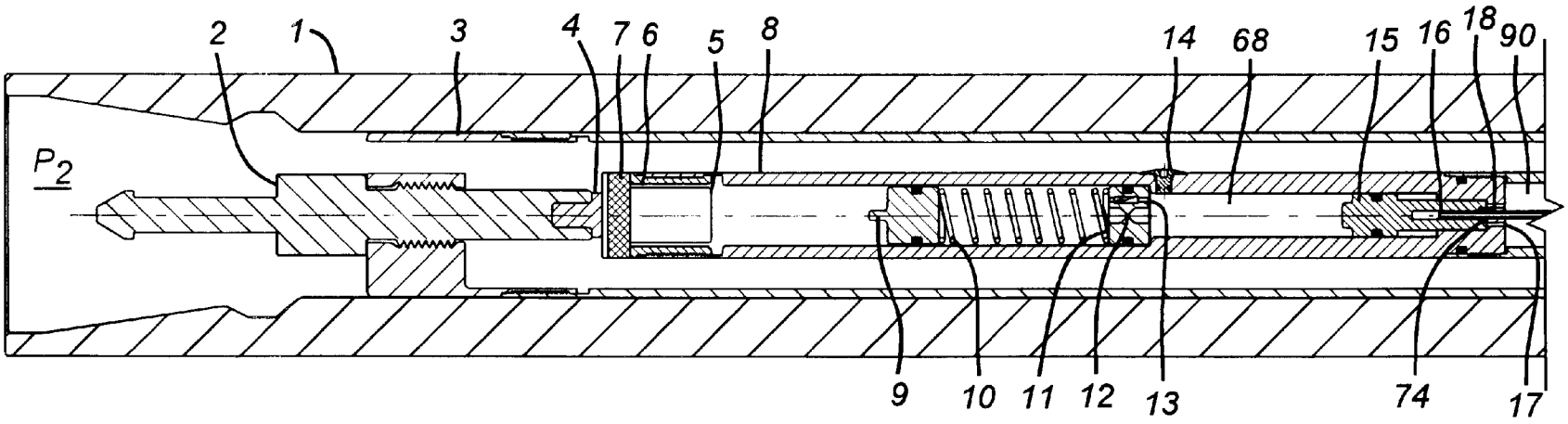
Figure 3B:
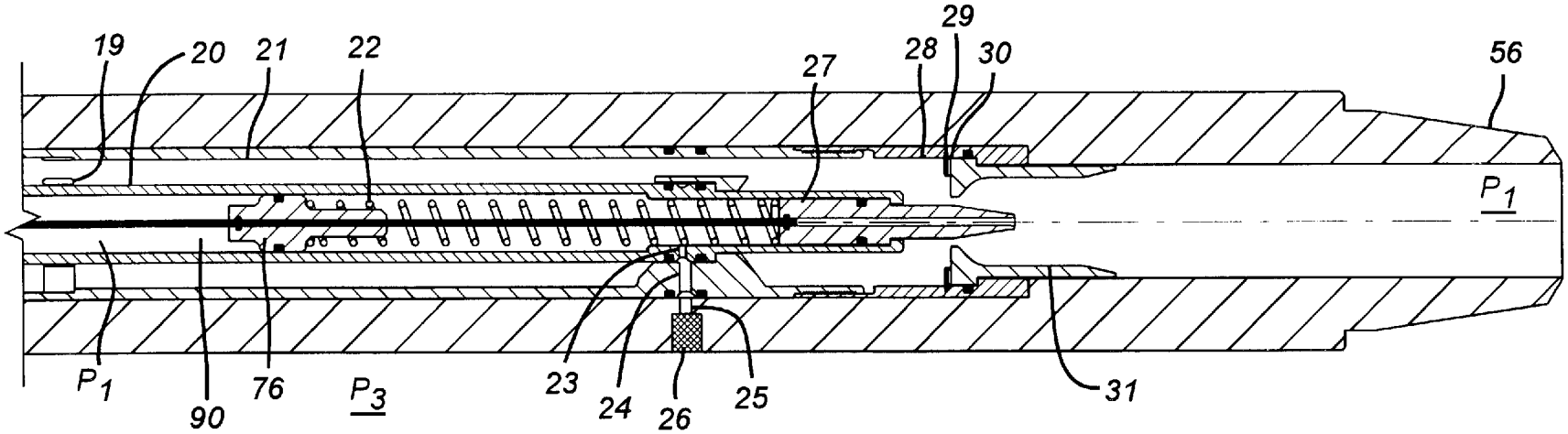

FIGS. 3*a–b* are the view of FIGS. 2*a–b*, with the pumps circulating, but with the bit off bottom.

Figure 4A:
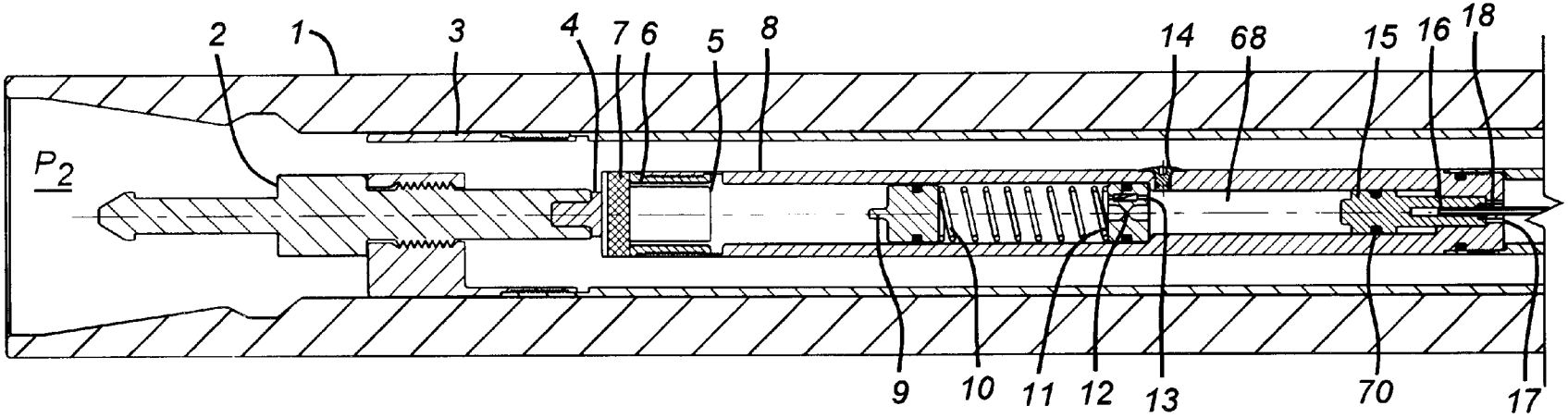
Figure 4B:
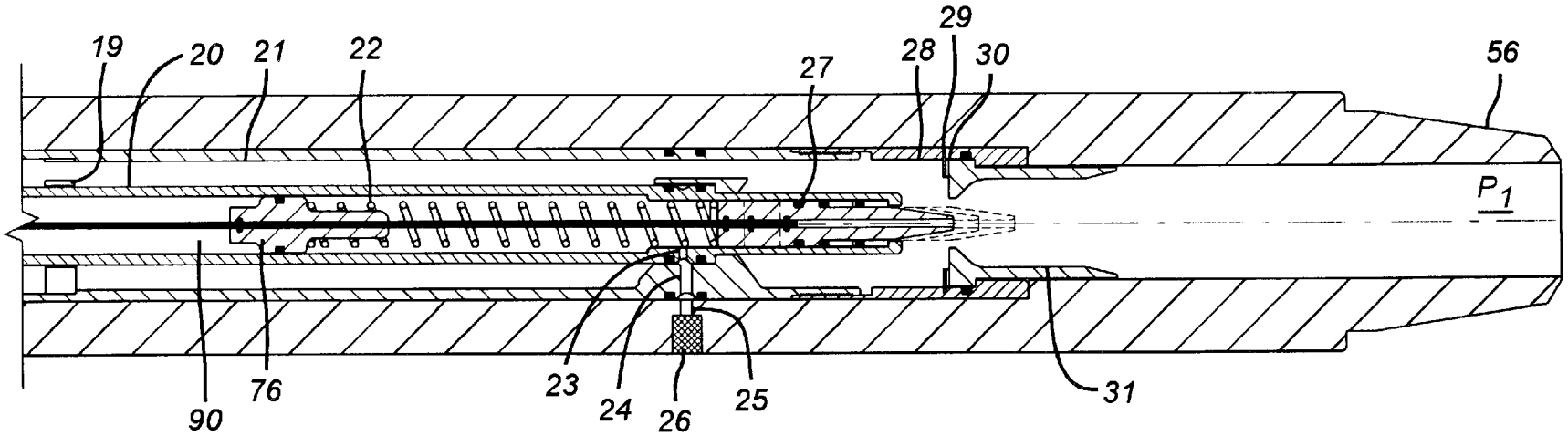

FIGS. 4*a–b* are the view of FIGS. 3*a–b*, with the pumps running and the drill bit on bottom.

DETAILED DESCRIPTION OF THE PREFERRED EMBODIMENT

The drillstring modulation valve of the present invention is illustrated in the bottomhole assembly illustrated in FIGS. 1 *a–c*. A drilling or tubing string 32, which can be rigid jointed pipe, reeled pipe or coiled tubing, supports a drillstring thruster 34 and related bottomhole assembly elements. The thruster 34 has an outer housing 36 and an internal pipe 38. The internal pipe 38 is reciprocally mounted within the outer housing 36 and extends as the drill bit 40 advances. The thruster 34 is responsive to pressure difference between internally of the bottomhole assembly, referred to as 42, and externally in an annulus around the assembly, referred to as 44. The apparatus A is connected to the internal pipe 38. Below the apparatus A, a measurement-while-drilling system can be inserted to supply data to the surface regarding formation conditions and/or the rotary orientation of the drill motor assembly. The bottomhole assembly of FIGS. 1 *a–c* also includes an upper stabilizer 46 and a lower stabilizer 48 between which is a drilling motor 50. Optionally, to assist in drilling deviated wellbores, bent subs 52 and 54 can be employed in the bottomhole assembly, as well as, or alternatively, other desirable steering arrangements may be used.

This type of a bottomhole assembly is typically used for deviated wellbores. The drilling motor 50 can be a progressive-cavity type of a motor which is actuated by circulation from the surface through the drillstring 32. The weight or force on the drill bit 40 is determined by the pressure difference internally to the thruster 34 at point 42 and the annular pressure outside at point 44. The drilling motor 50 is a variable resistance in this circuit in that the pressure drop across it is variable, depending on the load imposed on the motor 50 by torque created at the drill bit 40. For example, as drilling begins, the bit 40 causes an increase in load on the drilling motor 50, which increases the pressure drop between the drilling motor 50 and the annulus 44. That increase in pressure drop raises the pressure difference across the thruster 34 (if the apparatus A is not used) by raising the pressure at point 42 with respect to the pressure at point 44. As a result, the thruster 34 adds an incremental force through the drilling motor 50 down to bit 40. As additional weight is put on the bit 40, the drilling motor 50 increasingly bogs down to the point where this cycle continues until the drill bit 40 stalls the motor 50 due to the extreme downward pressure that is brought to bear on the bit 40 from the ever-increasing internal pressure at point 42 inside the thruster 34. The thruster 34, instead of feeding out the internal pipe 38 in direct compensation for the advancement of the bit 40, instead is urged by the rise in pressure internally at point 42 to feed out the internal pipe 38 at a greater rate than the advancement of the bit 40, thus adding the force on the bit, which in turn finally stalls the drilling motor 50. This had been the problem and the apparatus A of the present invention, when inserted in the bottomhole assembly, as shown in FIG. 1 *b*, addresses this problem. The apparatus A acts as a compensation device, which, as its objective, keeps the pressure as constant as possible at the internal point 42 of the thruster 34 despite variations in pressure drop that the drilling motor 50 created during drilling.

Referring now to FIGS. 2*a* and *b*, the apparatus A has a containment sub 1, which has a lower end 56 which is oriented toward the drilling motor 50, and an upper end 58, which is oriented toward the thruster 34. In order to describe the operation of the apparatus, the pressure adjacent lower end 56 will be referred to as $P_1$; the pressure adjacent the upper end will be referred to as $P_2$; and the annulus pressure outside the containment sub 1 will be referred to as $P_3$. Again, the objective is to keep $P_2$ as constant as possible.

The assembly shown in FIG. 2 starts near the upper end with lifting head 2, which is supported from the containment sub 1 at thread 60. Attached to the lower end of the lifting head 2 is compressive pad 4, which in turn is secured to a porous metal filter 7. Below the porous metal filter 7, liquid that gets through it flows through mud flow port 6 to a cavity 62 above delay valve piston 9. Delay valve piston 9 is sealed at its periphery by seal 64 to divide the delay valve tube 8 into cavity 62 and cavity 66. Delay valve spring 10 resides in cavity 66 and biases the delay valve piston 9 toward the porous metal filter 7. A delay valve orifice assembly 12 is located at the lower end of the delay valve tube 8. This is an orifice which, in essence, regulates the displacement of clean fluid in cavity 66 into cavity 68. Those skilled in the art will appreciate that movement of delay valve piston 9 downhole toward the lower end 56 will result in displacement of clean fluid, generally an oil, from cavity 66 through delay valve orifice block 11 into cavity 68 for ultimate displacement of piston valve 15. Piston valve 15 is sealed internally in delay valve tube 8 by seal 70. The piston valve 15 has a receptacle 72, which includes a seal 74, which ultimately straddles the low-pressure transfer tube 16, as shown by comparing FIG. 2*a* to FIG. 3*a*. The low-pressure transfer tube 16 extends to compensation tube body 20. Inside of compensation tube body 20 is compensation spring 22. Spring 22 bears on compensation piston 76 at one end and on the other end against modulating ram needle 27. Needle 27 is sealed internally in the compensation tube body 20 by seal 78. The compensating piston 76 is also sealed within the compensation tube body 20 by seal 80. Both the compensating piston 76 and the needle 27 are movable within the compensating tube body 20 for reasons which will be described below. In effect, the piston 76 and the needle 27 define a cavity 82 within the compensation tube body 20. The low-pressure transfer tube 16 spans the entire cavity 82, but is not in fluid communication with that cavity. A vent port 23 is in fluid communication with cavity 82. The port 23 is in fluid communication with cartridge vent port 24, which ultimately leads to transfer groove 25, which in turn leads to the porous metal filter 26. Accordingly, the pressure $P_3$ is communicated into the cavity 82. Port 24 can be sized to make cavity 82 operate as a dampener on the movements of needle 27. It can be directly connected to $P_3$ as shown or to an external or internal reservoir. The reservoir can have a floating piston with one side exposed to $P_3$ through the filter 26. This layout can reduce potential plugging problems in filter 26.

Referring now toward the lower end of the compensation tube body 20, the needle 27 extends beyond an opening 84 and into the restrictor orifice 31. The preferred components for the needle 27 and the restrictor orifice 31 is a carbide material. As illustrated in FIG. 2*b*, the pressure at the inlet of the drilling motor 50 (see FIG. 1 *b*) is the pressure $P_1$, which is also illustrated in FIG. 2*b*. Normal flow to the motor 50 occurs from upper end 58 through passage 86 down around needle 27 and out lower end 56.

In the position shown in FIG. 2*a*, the low-pressure transfer tube 16 communicates with cavity 88, which in turn through openings or ports 17 communicates with cavity 90. Those skilled in the art will appreciate that as long as the seals 74 do not straddle the top end of the low-pressure transfer tube 16, the pressure $P_1$ at the lower end 56 communicates through low-pressure transfer tube 16 through cavity 88 and into cavity 90 so that the pressure $P_1$ acts on the area of the compensating piston 76 exposed to cavity 90. A seal 92 retains the pressure $P_1$ in cavity 90 while, at the same time, allowing the compensating piston 76 to move with respect to the low-pressure transfer tube 16. The low-pressure transfer tube 16 is secured to the needle 27 and is placed in alignment with a longitudinal passage 94 in the needle 27. A seal 96 separates the pressure $P_1$, which exists in passage 94 and in low-pressure transfer tube 16, from pressure $P_3$, which exists in cavity 82. Seal 78 serves a similar purpose around the periphery of the needle 27.

The significant components of the apparatus now having been described, its operation will be reviewed in more detail. FIGS. 2*a–b* reflect the apparatus A in the condition with the surface pumps turned off. In that condition, the spring 22 pushes the compensation piston 76 against delay valve tube 8 and, at the same time, pushes the needle 27 against the ledge formed by opening 84. At the same time the delay valve spring 10 pushes the delay valve piston 9 against hydrostatic pressures applied through the upper end 58 through the porous metal filter 7 and mud flow port 6. At this point with no flow, $P_1=P_2$ and the delay valve piston 9 is in fluid pressure balance.

When the surface pumps are turned on, the first objective of the apparatus A of the present invention is to obtain a preload force on the needle 27, which actually compensates for the mechanical condition of the motor 50 and any other variables downhole which have affected the pressure drop experienced in the region of the drilling motor 50 and the bottomhole assembly since the last time the pumps were operated from the surface. The desired preload acts to put a force on the needle 27 which will prevent it from rising on increasing pressure $P_1$ until a predetermined level is exceeded. Stated in general terms, the pressure $P_2$ is maintained at a desirably a steady level as possible by modulation of the position of needle 27 responsive to fluctuations in pressure $P_1$. Variations in pressure $P_1$ will occur as a result of the drilling activity being conducted with bit 40. Accordingly, with the surface pumps turned on and the bit 40 off of bottom, meaning that there is no drilling going on, the pressure $P_2$ increases with respect to pressure $P_3$ as circulation is established. When this occurs, the pressure $P_1$ also increases with respect to pressure $P_3$. As previously stated, cavity 82 communicates with pressure $P_3$ through the porous metal filter 26. By proper configuration of the compensating piston 76, the pressure $P_1$, which exceeds the pressure $P_3$, communicates through the low-pressure transfer tube 16 into cavity 88 through ports 17 and into cavity 90, and onto the top of compensating piston 76. Ultimately, an imbalance of forces occurs on compensating piston 76 due to pressure $P_1$ in cavity 90 and $P_3$ in cavity 82 which causes piston 76 to compress the compensation spring 22. The compensating piston 76 is designed to complete its movement and reach an equilibrium position before the piston valve 15 moves downward sufficiently to bring the seal 74 over the upper end of the low-pressure transfer tube 16. FIGS. 3*a* and *b* show the conclusion of all the movements when the pumps on the surface are turned on and the bit 40 is off of bottom. However, the movement occurs sequentially so that the piston 76 finds its preload position, shown in FIG. 3*b*, before movement of piston valve 15 occurs. Movement of piston valve 15 occurs as the pressure $P_2$ ultimately communicates with cavity 62, as described previously. The fluids in the well, which have been passed through the porous metal filter 7 push on the delay valve piston 9 and ultimately the delay valve spring 10 is compressed. As previously stated, the cavity 66 is filled with a clean oil which is ultimately forced through the orifice assembly 12 into cavity 68 by movement of delay valve piston 9. The orifice assembly 12 is designed to provide a sufficient time delay, generally 1–2 minutes, so that the compensating piston 76 can find its steady state position. Those skilled in the art will appreciate that when the surface pumps are turned on and flow is initiated, it takes a little time for the circulating system to stabilize. Thus, one of the desirable functions of the apparatus A is that the low-pressure transfer tube 16 is not capped by the piston valve 15 by virtue of seal 74 until the compensating piston 76 has found its desirable position shown in FIG. 3*b*. In the position shown in FIG. 3*b*, the forces on the compensating piston 76 have reached equilibrium. Thus, the pressure $P_3$ acting on the bottom of compensating piston 76 in conjunction with the force of compensation spring 22 becomes balanced with the pressure $P_1$ that is acting in the now enlarged cavity 90. Ultimately, enough clean fluid passes through the delay valve orifice assembly 12 to urge the piston valve 15 downwardly to the position shown in FIG. 3*a* such that the seal 74 straddles the low-pressure transfer tube 16. As soon as this occurs, the compensation piston 76 is in effect isolated from further fluctuations of the pressure $P_1$. In effect, the pressure at the lower end 56 can no longer communicate with the top end of the compensating piston 76 because the piston valve 15 has cutoff the access to cavity 90 by capping off the low-pressure transfer tube 16.

After having attained the position shown in FIGS. 3*a* and *b*, the drilling with bit 40 begins. This puts an additional load on the motor 50 which in turn raises the pressure $P_1$. As the pressure $P_1$ rises, the needle 27 has a profile, which in turn decreases the pressure drop across the restrictor orifice 31 as the needle 27 moves upwardly. Due to the profile of needle 27 as the needle moves up, the pressure drop change per unit of linear movement is increased. The spring 22 resists upward movement of the modulation ram needle 27. At this point in time when the bit 40 contacts the bottom of the hole, the compensating piston 76 is immobilized against upward movement because the piston valve 15 has capped off the pressure $P_1$ from communicating with cavity 90. Since $P_2$ is always greater than $P_1$ due to frictional losses and the pressure drop across the orifice 31, the pressure in cavity 68, which is $P_2$, keeps the piston valve 15 firmly bottomed in the delay valve tube 8. As previously stated, the seal 70 prevents the pressure $P_2$, which is in cavity 68 in FIG. 4*a* from getting into cavity 90. Accordingly, the compensating piston 76 now is in a position where it supports the spring 22 with a given preload force on the needle 27. As the motor 50 takes a greater pressure drop, which tends to increase $P_1$, the upward forces on needle 27 eventually exceed the downward forces on needle 27. The downward forces on needle 27 comprise the pressure $P_3$ acting on top of the needle 27 in cavity 82 in combination with the preload force from spring 22. Thus, an increase in the pressure $P_1$ which exceeds $P_3$ backs the needle 27 out of the orifice 31 removing some of the pressure losses that had been previously taken across the orifice 31. Thus, the increase in pressure drop at the motor 50 is compensated for by a decrease in pressure drop at the orifice 31 with the net result being that very little, if any, pressure change occurs as $P_2$ remains nearly steady. In other words, the system pressure drops upstream of the upper end 58 remains steady and all that desirably occurs is an increase in pressure drop through the motor 50 compensated for by a corresponding decrease in pressure drop across the restrictor orifice 31 with the net result that the thruster 34 sees little, if any, pressure change as indicated by the symbol $P_2$.

When the pumps are again turned off at the surface, the apparatus A quickly resets itself. As the pumps are turned off at the surface $P_2$ decreases, thus reducing the pressure in cavity 62. A check valve 13 allows flow into cavity 66 from cavity 68. Accordingly, when the spring 10 pushes the piston 9 upwardly, it draws fluid through the check valve 13, which in turn draws fluid out of cavity 68. The drawing of fluid out of cavity 68 brings up the piston valve 15 and ultimately takes the seal 74 off of the top of the low-pressure transfer tube 16. When this occurs, $P_1$ can then communicate through the low-pressure transfer tube 16 and into cavity 90 as previously described. Ultimately, with no fluid circulating, $P_3$ will be equal to $P_1$ and the spring 22 will bias the compensating piston 76 back to its original position shown in FIG. 2*b*. Therefore, the next time the surface pumps are started, the process will repeat itself as the compensating piston 76 seeks a new equilibrium position fully compensating for any changes in condition in the circulating system from the drilling motor 50 down to the bit 40.

Those skilled in the art will appreciate that the configuration of the compensating piston 76 is selected in combination with a particular spring rate for the compensating spring 22 to deliver a preload force on the needle 27 within a limited range. Too little preload is undesirable in the sense that minor pressure fluctuations in $P_1$ during drilling will cause undue oscillation of the needle 27. On the other hand, if the preload force is too great, the system becomes too insensitive to changes in $P_1$, thus adversely affecting the operation of the thruster 34 and if extreme enough causing the thruster 34 to load the bit 40 to the extent that the motor 50 will bog down and stall. Thus, depending on the parameters of the drilling motor 50 and the bit 40, the configurations of the compensating piston 76 and spring 22, as well as the profile of the needle 27 can be varied to obtain the desired performance characteristics. Similarly, the orifice assembly 12 can be designed to provide the necessary delay in the capping of the low-pressure transfer tube 16 to allow the system to stabilize before the low-pressure transfer tube 16 is capped. This, in turn, allows the compensating piston 76 to seek its neutral or steady state position before its position is immobilized as the piston valve 15 caps off the low-pressure transfer tube 16. In essence, what is created is a combination spring and damper acting on the needle 27. The spring is the compensation spring 22, while the damper is the cavity 82 which varies in volume as fluid is either pushed out or is sucked in through port 24 or the porous metal filter 26 which can act as an orifice in the damper system.

The needle 27 can be controlled in other ways, such as directly by a stepper motor or a linear motor. The changing pressures at $P_1$ can be sensed and the position of the needle 27 can be adjusted accordingly. In the alternative, the position of the needle 27 can be controlled from the surface by a signal delivered to a stepper motor which would, in essence, take the place of the piston 76 and the spring 22, as shown in the figures. By controlling the position of the needle 27, the amount of force applied to the thruster 34 can be varied so as to optimize the operation of the bit 40. Thus, to improve rates of penetration, depending on the nature of the formation, the design of the bit, and the rotational speed of the bit, the weight on bit can be regulated from the surface by control of the needle 27. Both hydraulic and pneumatic control and actuation methods can be used in place of the stepper motor as disclosed in the description above.

Another advantage of the layout as shown in FIGS. 2*a* and *b* is that the drillstring is dynamically discoupled from the bit 40 because of the use of the thruster 34. Fluctuations in the drillstring or caused by the bit rotation are absorbed in the thruster assembly 34. Thus, the operation of the bit is unaffected by dynamics of the drillstring and vice versa.

The amount of extension of the thruster 34 can be a measured variable and communicated to the surface so as to assist in orientation of the downhole equipment affected by movement of the thruster 34.

The design of the thruster 34 can be in a multiplicity of cylinders which are actuated by a valving mechanism to control the force of the extension, while at the same time measuring variables such as motor speed or rate of penetration and regulating the single- or multiple-component thruster accordingly to optimize the operation of the bit for maximum rate of penetration. Thus, a telescoping assembly, such as shown in U.S. Pat. No. 5,205,364, can be optimized with a fluid-controlled system to regulate the degree or force of extension of the telescoping thruster assembly in an effort to optimize the drilling rate.

Those skilled in the art will now appreciate that the apparatus A provides several important benefits. It is self-contained and it is a portion of the bottomhole assembly. Each time the surface pumps are turned on the compensating feature adjusts the preload on the needle 27 to account for variations within the circulating system. Once in operation during drilling, the system acts to smooth out pressure fluctuations caused by changes in the drilling activity so that the pressure fluctuations are isolated as much as possible from the thruster 34. With these features in place, drilling can occur using a downhole motor. Downhole motors are desirable when using coiled tubing or when the string, even though it is rigid tubing, is sufficiently long and flexible to the extent that a downhole motor becomes advantageous. The thruster system with disclosed control methods can also be used in drilling assemblies without drilling motors. The system using the apparatus A resets quickly using the check valve feature and stands ready for a repetition of the process the next time the surface pumps are turned on.

It should be noted that the normal pressure drop across the orifice 31 with the bit 40 off of bottom is approximately 400 or 500 psi or, better stated, should equal or slightly exceed the expected maximum drilling pressure drop expected to be generated by the drilling motor at full load conditions, in the preferred embodiment. That pressure drop is reduced during operation as the drilling motor 50 resistance increases which causes the needle 27 to compensate by backing out of the orifice 31, thus reducing the pressure drop. It should also be noted that the amount of preload provided by the compensation spring 22 needs to be moderated so as not to be excessive. Excessive preload on the needle 27 reduces the sensitivity of the apparatus A in that it requires the pressure $P_1$ to rise to a higher level prior to the apparatus reacting by moving the needle 27 against the spring 22. Thus, a higher preload on spring 22 also reduces sensitivity. Those skilled in the art can use known techniques for adjusting the variables of preload and needle profile within an orifice 31 to obtain not only the desired pressure compensation result but the appropriate first, second, and higher order responses of the control system so that a stable operation of the modulation ram needle 27 in orifice 31 is achieved.

The foregoing disclosure and description of the invention are illustrative and explanatory thereof, and various changes in the size, shape and materials, as well as in the details of the illustrated construction, may be made without departing from the spirit of the invention.

What is claimed is:

1. A downhole drilling assembly, comprising:

a downhole motor supported on tubing;

a bit driven by said motor;

a thruster mounted to said tubing which extends in length for application of a desired weight on said bit;

a compensating device to compensate for pressure change in said tubing caused by said bit or said motor to allow proper functioning of said thruster.

2. The assembly of claim 1, wherein:

said compensating device further comprises a variable orifice adjacent said thruster.

3. The assembly of claim 2, wherein:

said variable orifice comprises a movable member biased in a direction where the orifice is made smaller.

4. The assembly of claim 3, further comprising:

a preload adjustment acting on said movable member, said preload adjustment responsive to applied pressure to said compensating device.

5. The assembly of claim 4, wherein:

said preload adjustment sensing the pressure difference between pressure adjacent said variable orifice ($P_1$) and an annulus pressure outside said compensating device ($P_3$);

said preload adjustment comprises a first piston movable responsive to the pressure difference of $P_1$–$P_3$.

6. The assembly of claim 5, further comprising:

a locking device to prevent further movement of said first piston after said first piston reaches equilibrium under a pressure difference of $P_1$–$P_3$ with said bit off the hole bottom, thereby locking in a predetermined preload force on said movable member.

7. The assembly of claim 6, wherein:

said locking device isolating one side of said first piston from pressure $P_1$ after it reaches an equilibrium position due to pressure $P_1$ acting on one side and pressure $P_3$ acting on the other side.

8. The assembly of claim 7, wherein:

said locking device comprises a second piston whose movement to a position where said first piston's movement is locked is delayed to allow said first piston time to reach an equilibrium position based on $P_1$–$P_3$ with said bit off the hole bottom.

9. The assembly of claim 8, wherein:

said preload adjustment comprising a spring between said first piston and said movable member, said spring disposed in a sealed cavity exposed to said annulus pressure ($P_3$) and to one side of both said first piston and said movable member.

10. The assembly of claim 9, further comprising:

a tube sealingly extending into a path through said movable member, said tube sealingly extending through said first piston to communicate said pressure $P_1$ to a second side of said piston.

11. The assembly of claim 10, wherein:

said second piston closing off pressure $P_1$ from said second side of said first piston by sealingly covering an end of said tube extending through said first piston.

12. The assembly of claim 11, wherein:

said second piston is responsive to a pressure build-up at an inlet to said compensation device ($P_2$) to move to seal off said tube.

13. The assembly of claim 12, further comprising:

a third piston exposed to pressure $P_2$ which displaces fluid through an orifice to said second piston to effect a time delay of movement of said second piston and, as a result, the sealing of said tube until said first piston reaches equilibrium when said first piston is exposed to a pressure difference of $P_1$–$P_3$ with said bit off the bottom.

14. The assembly of claim 9, wherein:

said spring with said preload from movement of said first piston allows movement of said movable member in response to fluctuation of $P_1$ to change the orifice size so as to keep pressure at an inlet to said compensation device $P_2$ nearly steady.

15. The assembly of claim 14, wherein:

said cavity communicating to said annulus through a restricting opening so as to allow said cavity and the fluid therein to act as a fluid dampener in conjunction with said spring to regulate compensatory movements of said movable member responsive to changes in $P_1$.

16. A bottomhole drilling assembly, comprising:

a fluid-operated motor driving a bit;

an extendable thruster which is pressure-responsive to control weight on the bit during drilling;

a compensator adjacent said thruster to compensate for pressure changes created by operation of said motor and said bit.

17. The assembly of claim 16, wherein:

said compensator comprises a member movable to create a variable orifice responsive to pressure changes induced by operation of said motor and said bit.

18. The assembly of claim 17, further comprising:

an automatic preload assembly to control the amount of preload bias on said member responsive to an internal pressure ($P_1$) below said variable orifice due to flow through said motor and bit, and an annules pressure ($P_3$) in the surrounding annular space outside the bottomhole drilling assembly, both pressures sensed with said motor turning and said bit off the well bottom.

19. The assembly of claim 18, further comprising:

a lock system to lock in said preload force after said preload assembly has reached its equilibrium position responsive to a pressure difference $P_3$–$P_1$.

20. The assembly of claim 19, wherein said preload assembly further comprises:

a movable first piston having a first side defining, in conjunction with said movable member, a cavity exposed to said annular space and said annules pressure $P_3$ and having a spring between said first piston and said movable member;

said first piston having a second side selectively exposed to said pressure $P_1$ until said lock system isolates $P_1$ from said second side of said first piston.

21. The assembly of claim 20, wherein:

said cavity has a restriction in its communication with said annulus pressure $P_3$ so as to allow the fluid therein to dampen movement of said movable member in conjunction with the bias to said movable member applied by said spring.

22. The assembly of claim 21, wherein:

said movable member having a passage which communicates the pressure $P_1$ through a tube to a second side of said first movable piston, said lock system selectively covering an end of said tube to isolate said second side of said first piston from the pressure $P_1$.

23. The assembly of claim 22, wherein:

said lock system comprises a second piston which moves in sealing contact with said end of said tube after a delay long enough to allow said first piston to reach equilibrium when exposed to a pressure differential of $P_1$–$P_3$ when said bit is off the well bottom.

24. The assembly of claim 23, wherein:

said delay is accomplished by a third piston with one side responsive to pressure adjacent said thruster ($P_2$), said third piston displacing fluid through an orifice to said second piston at a controlled rate such that movement of said second piston and closing off said tube is delayed until said first piston is in said equilibrium position.

* * * * *